US006319083B1

(12) United States Patent
Alwan

(10) Patent No.: US 6,319,083 B1
(45) **Date of Patent: *Nov. 20, 2001**

(54) PROCESS FOR LOW TEMPERATURE SEMICONDUCTOR FABRICATION

(75) Inventor: James J. Alwan, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/569,791

(22) Filed: May 12, 2000

Related U.S. Application Data

(63) Continuation of application No. 09/356,852, filed on Jul. 19, 1999, now Pat. No. 6,080,032, which is a continuation of application No. 08/949,052, filed on Oct. 10, 1997, now abandoned.

(51) Int. Cl.[7] ..... H01J 9/02
(52) U.S. Cl. ..... 445/24
(58) Field of Search ..... 445/24, 50; 438/20

(56) References Cited

U.S. PATENT DOCUMENTS 5,051,134 * 9/1991 Schnegg et al. ..... 438/974
5,192,717 * 3/1993 Kawakami et al. ..... 438/479
5,227,699 * 7/1993 Busta ..... 313/309
5,527,200 * 6/1996 Lee et al. ..... 445/50
5,688,707 * 11/1997 Lee et al. ..... 438/20
5,863,232 * 1/1999 Lee ..... 445/50
5,872,052 * 2/1999 Iyer ..... 438/622
5,923,948 * 7/1999 Cathey, Jr. ..... 438/20
5,981,303 * 11/1999 Gilton ..... 438/20
6,080,032 * 6/2000 Alwan ..... 445/50

* cited by examiner

*Primary Examiner*—Kenneth J. Ramsey
(74) *Attorney, Agent, or Firm*—Trop, Pruner & Hu, P.C.

(57) ABSTRACT

A method for forming semiconductor devices without utilizing high temperature processing involves forming a surface porous silicon layer. The surface porous silicon layer may be removed by selective etching or it may be oxidized and then removed by selective etching. In the case of a field emission display, the porous silicon formation process is sufficiently controllable that uniform emitters may be formed. Moreover, by maintaining the structure at a temperature below the temperature at which substantial diffusion of alkaline constituents occurs, soda-lime glass may be used as a substrate for making semiconductor devices.

8 Claims, 2 Drawing Sheets

PROCESS FOR LOW TEMPERATURE SEMICONDUCTOR FABRICATION

This application is a continuation of U.S. patent application Ser. No. 09/356,852 filed Jul. 19, 1999, now U.S. Pat. No. 6,080,032, which is a continuation of U.S. patent application Ser. No. 08/949,052 filed Oct. 10, 1997 abandoned.

BACKGROUND OF THE INVENTION

This invention relates generally to techniques for forming semiconductor devices such as field emission displays and particularly, in one embodiment, to techniques for sharpening the emitters of field emission displays.

There is currently considerable interest in field emission displays as an alternative to liquid crystal displays for use in electronic devices, such as laptop computers. Field emission displays offer many advantages. However, large displays must be formed on large supporting structures. Conventional silicon wafers have some drawbacks as the supporting structure for large field emission displays. The drawbacks include the fact that current wafer sizes may not be sufficiently large to accommodate these applications. Moreover, a wafer, of the size necessary to form a large field emission display on a single wafer, would be relatively expensive.

Therefore, there is some interest in developing field emission displays formed on structures called baseplates other than silicon wafers. One highly advantageous structure uses an amorphous silicon layer atop a glass supporting structure. These baseplates have a number of advantages including the ability to form large displays at reasonable cost. On the other hand, these structures are not amenable to high temperature processing normally associated with silicon wafer processing. By high temperature processing, it is intended to refer to the normal diffusion processes which take place temperatures on the order of 700° C. and higher.

For example, one problem that arises in using non-silicon wafer based support structures is that conventionally, the emitters are formed using high temperature oxide steps. One example would be that conventionally high temperatures may be utilized to sharpen the emitter tips so as to increase the emission efficiency of those devices. However, oxidizing processes conventionally require temperatures on the order of 900° C. and thus, are not suitable for some silicon-glass supporting structures.

One advantageous material for forming baseplates is soda-lime glass. However, soda-lime glass includes alkaline constituents, which may diffuse into and contaminate a silicon layer deposited on the glass baseplate. A number of techniques have been developed to attempt to isolate the silicon layer from the underlying soda-lime glass to prevent contamination from the alkaline constituents. One such technique is to use an intermediate barrier layer.

Thus, there is a need for a way of making structures such as glass structures that may be adversely affected by contaminants in the glass structures.

SUMMARY OF THE INVENTION

In accordance with one aspect, a method of forming an emitter for a field emission display includes the step of forming an upstanding silicon feature on a semiconductor layer. A porous silicon layer is formed in the surface of the upstanding feature. At least a portion of the porous silicon layer is then removed.

In accordance with another aspect of the present invention, a method of forming a field emission display includes the step of forming an emitter structure from a semiconductor layer. The tip of the emitter structure is sharpened without using high temperatures.

In accordance with still another aspect of the present invention, a process for making a semiconductor device includes the step of forming a silicon structure. A porous silicon layer is created on the structure. The structure is oxidized at a temperature lower than is typical for solid, non-porous silicon and the oxidized porous silicon is selectively removed.

In accordance with still another aspect, a method of forming a field emission display includes the step of forming a silicon structure having a silicon layer on a glass substrate. A layer of porous silicon is created in the surface of the silicon layer. The porous silicon is oxidized at a temperature below 700° C. The oxidized porous silicon layer is then selectively removed.

In accordance with another aspect, a method of making a semiconductor device using a soda-lime glass support layer includes the step of depositing a silicon layer directly on the soda-lime glass structure at a temperature below the temperature at which alkaline constituents in the soda-lime glass diffuse appreciably into the silicon layer. Features are defined in the silicon layer without using temperatures in excess of the temperature at which there is deleterious diffusion of alkaline constituents in the soda-lime glass into the silicon layer.

In accordance with yet another aspect of the present invention, a method for oxidizing and removing the oxidized layer from a silicon structure includes the step of oxidizing a silicon structure at a temperature below 700° C. The oxidized silicon structure is then removed. An oxide layer is formed on the structure at a temperature below 700° C. This oxide layer is then removed, as well.

In accordance with still another aspect of the present invention, a method of sharpening a tip formed in a silicon structure includes the step of forming a surface layer in the silicon structure which has micropassages which allow oxygen to penetrate the interior of the structure without bulk diffusion. The surface layer is selectively removed.

In accordance with yet another aspect of the present invention, a method of sharpening the tip of a silicon emitter includes the step of forming a layer of silicon on a silicon structure having a diffusivity to oxygen significantly greater than that of crystalline silicon. The layer is etched without applying a high oxidation temperature.

In accordance with another aspect of the present invention, a method for oxidizing silicon at low temperature includes the step of surface oxidizing a silicon layer without high temperature. When the silicon surface oxidation is substantially prevented by the overlying oxide growth, the overlying oxide growth is removed and the newly exposed silicon surface is surface oxidized without high temperature.

DESCRIPTION OF THE PREFERRED EMBODIMENTS

Figure 1:
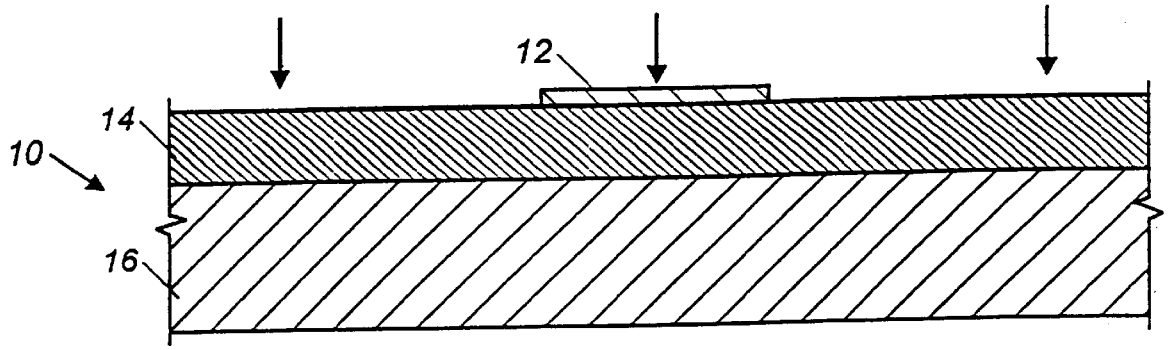
FIG. 1 is an enlarged cross-sectional view of one step in the process for forming emitters.

Referring to the drawing wherein like reference characters are used for like parts throughout the several views, a semiconductor structure 10 includes a baseplate 16, and a silicon layer 14. The patterned layer 12 is situated on the upper surface of the silicon layer 14 to act as a mask against the etching process.

The baseplate 16 may be formed of a silicate glass such as soda-lime glass, quartz or other types of glass, having suitable insulating and mechanical characteristics. The silicon layer 14 may be formed of amorphous silicon doped with an N-type dopant such as phosphorus. It may be formed by plasma enhanced chemical vapor deposition (PECVD) on the baseplate 16. The silicon layer 14 could also be polysilicon. In any case, the silicon layer 14 is deposited at low temperatures, typically on the order of about 300° C.

Figure 2:
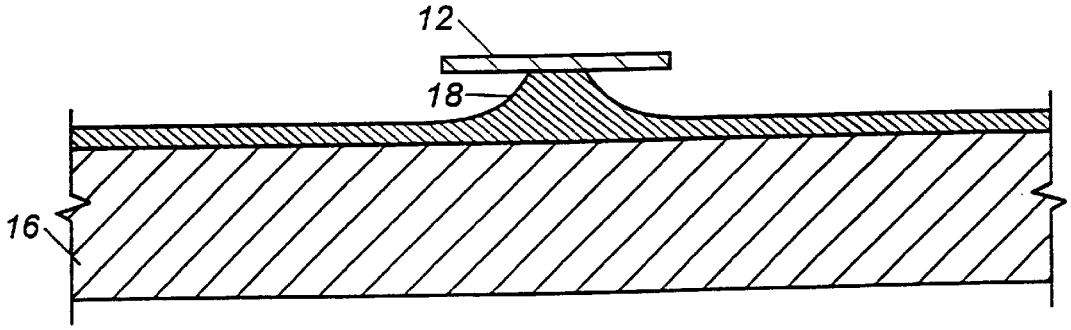
FIG. 2 is an enlarged cross-sectional view of the embodiment shown in FIG. 1 after etching.
Figure 3:
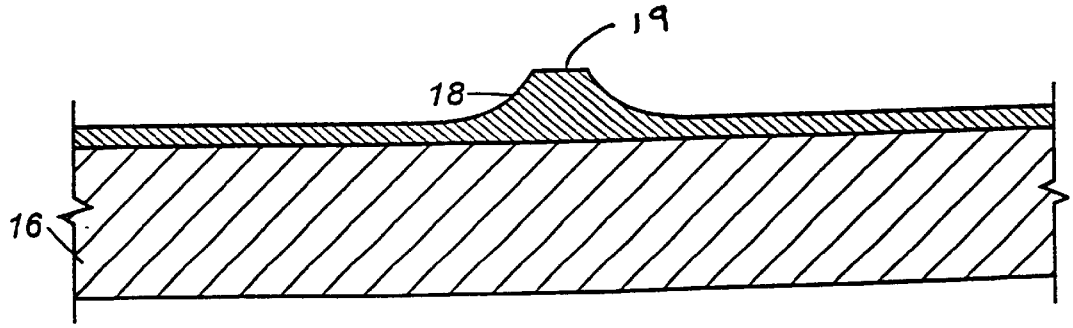
FIG. 3 is an enlarged cross-sectional view of the embodiment shown in FIG. 2 after additional etching.

The patterned layer 12 or "hard mask," which acts as an etching mask, may be formed of oxide or any other suitable material which may be selective to the etch of the underlying silicon material layer 14. The patterned layer 12 must be sufficiently thick to act as a mask against the etching process, indicated by arrows in FIG. 1. The etching process is conveniently a plasma etch with controlled anistropy which undercuts the mask 12 as shown in FIG. 2. A variety of techniques are available for etching the silicon layer 14 to achieve the desired configuration. One such technique is disclosed in U.S. Pat. No. 5,532,177 which is hereby expressly incorporated herein by reference. The process may be continued until a silicon structure 18 is formed having a blunt tip 19 or, if desired, the process can be continued until a relatively sharp tip 19 (not shown) is formed.

After the silicon structure 18 has been formed, the hard mask 12 may be removed by a conventional wet etching technique such as a buffered oxide etch. One particular buffered oxide etch is $HF:NH_3F$.

The baseplate 16 with the partially defined feature 18 formed thereon is then subjected to a process which forms a layer 20 of porous silicon in the exposed surface of the feature 18. This may be done electrochemically by dipping the structure in a bath of hydrofluoric acid and ethanol, having a voltage between an electrode (not shown) and the structure 10 on the order of 20 to 200 volts while passing current between the two on the order of 5 milliamps to 150 milliamps. This forms the porous silicon layer 20 on the remaining silicon 18 which may be amorphous silicon. For example, the porous silicon layer 20 may be from about 500 to several thousand Angstroms in thickness.

Figure 4:
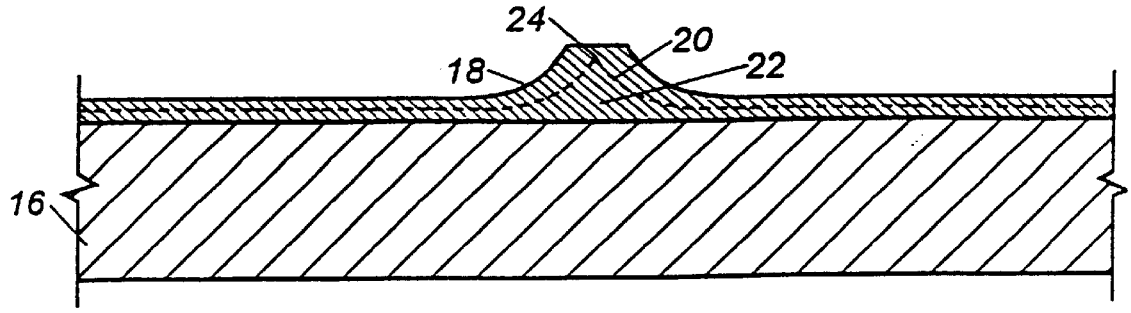
FIG. 4 is an enlarged cross-sectional view of the embodiment shown in FIG. 3 after formation of porous silicon.
Figure 5:
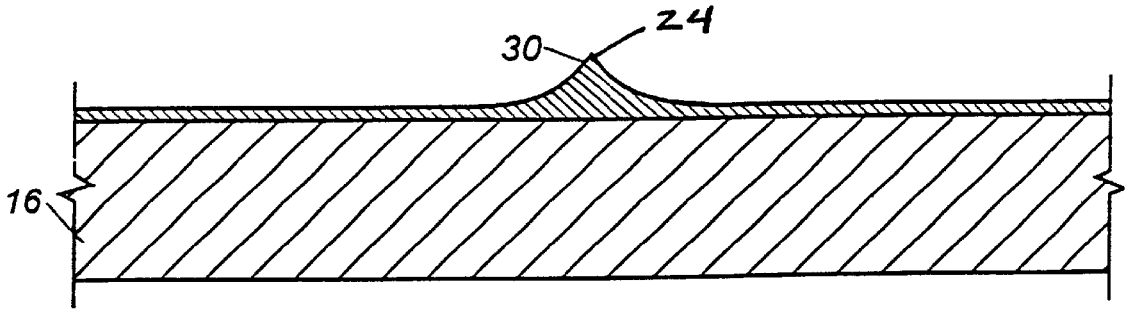
FIG. 5 is an enlarged cross-sectional view of the embodiment shown in FIG. 4 after etching of porous silicon.

The structure shown in FIG. 4 may then be subjected to a selective etch to selectively remove the porous silicon layer 20 while leaving the underlying silicon region 22 substantially intact. A sharp tip 24, is formed which is effective in emitting electrons. The selective etchant preferably has a high selectivity for porous silicon as opposed to amorphous silicon (or any other form of silicon) used to form the underlying layer 14.

A variety of etches may be utilized to accomplish this result. For example, a conventional poly etch, diluted to slow its operation, may be utilized. One conventional poly etch uses nitric acid and hydrofluoric acid in a ratio of 95 to 5, respectively. A suitable etchant for use in the present application may be an etch which uses nitric acid, hydrofluoric acid and deionized water in the ratio of 5 to 5 to 90, respectively. Another useful etch is an inert gas plasma etch. One such etch would use argon in an ion milling, plasma etch using relatively high bias potentials.

Alternatively, the porous silicon layer 20 may be oxidized at low temperature before removing it by etching. Preferably, the oxidation occurs at a relatively low temperature so as not to cause alkaline constituent diffusion from the glass baseplate 16 or mechanical substrate modification such as warping, cracking, etc. Thus, chemical oxidation techniques must be utilized that have a rate of oxidation of porous silicon which is much higher than the rate of oxidation of the silicon layer 22, which may be amorphous silicon. This may be accomplished electrochemically, for example, in a bath of nitric acid. The porous silicon, which is a highly open structure, is converted readily to oxide at low temperatures in the presence of a strong oxidizer. Then a conventional etch, such as a buffered oxide etch, may be utilized to selectively remove the oxide from the underlying amorphous silicon layer.

One way to do this is to successively oxidize and then remove the oxidized material followed by reoxidation and removal. Because low temperatures are utilized, it is difficult for the oxidation process to proceed deep into the structure. Because of the reticulated structure of the porous silicon, this may not be necessary; however, where the porous silicon has a reticulated structure of sufficient thickness, it may no longer be possible for oxygen, in one step, to reach the interface between the oxide and the silicon layer at low temperatures.

Generally, oxidation reactions occur at relatively high temperatures on the order of 900° C. This enables at least two processes to be implemented. Oxidation occurs through the reaction of oxygen at the silicon surface. This process normally dominates in the initial stages of oxidation. However, as the oxide builds up, a second mechanism begins to become more dominant. This mechanism involves the diffusion of oxygen through the oxide to the silicon surface. A third mechanism, which is not of considerable importance here, involves oxidation across the oxide structure.

High temperatures on the order of 900° C. to 1100° C. are normally utilized to cause sufficient diffusion of oxygen through the growing oxide layer. Thus, as used herein, "high temperature" refers to processes wherein significant diffusion of oxygen through oxide can occur and this would generally be in a range above 700° C. "Low temperature" processes would be those below 700° C. for purposes of the present application. Because of the nature of the baseplate 16, for example, it may be desirable to use low temperatures for all processing steps. In many applications, temperatures below 540° C. would be most advantageous.

Thus, an oxide layer may be formed by surface oxidation without the need for diffusion of oxygen through a thick oxide. This oxide layer can be subsequently removed by an etching step. The process can be repeated as many times as is necessary such that the oxidation reaction is almost always dominated by surface oxidation. Because of the relatively fine structure of the porous silicon, the surface is punctuated by fine structures which may be oxidized in this fashion.

In general, low temperature oxidation is facilitated by the porous structure of porous silicon because oxygen can get into the surface of porous silicon without the need for diffusing through a well ordered crystal structure. While amorphous silicon is generally a disordered crystal structure, it could be characterized as a closed structure relative to the open structure of porous silicon. Therefore, it is possible for oxygen molecules to penetrate into the porous silicon without the necessity of high temperatures.

Once an oxide is formed, a selective etch may be utilized which has a high selectivity to oxidized porous silicon compared to unoxidized amorphous silicon. The etch compositions described previously could be used, for example. In this way, a well controlled process may be implemented which forms a relatively sharp tip 24. The shape of the impinging front of porous silicon formation and the shape of the impinging front of porous silicon oxide is such that when these materials are removed, a relatively sharp tip 24 results.

Figure 6:
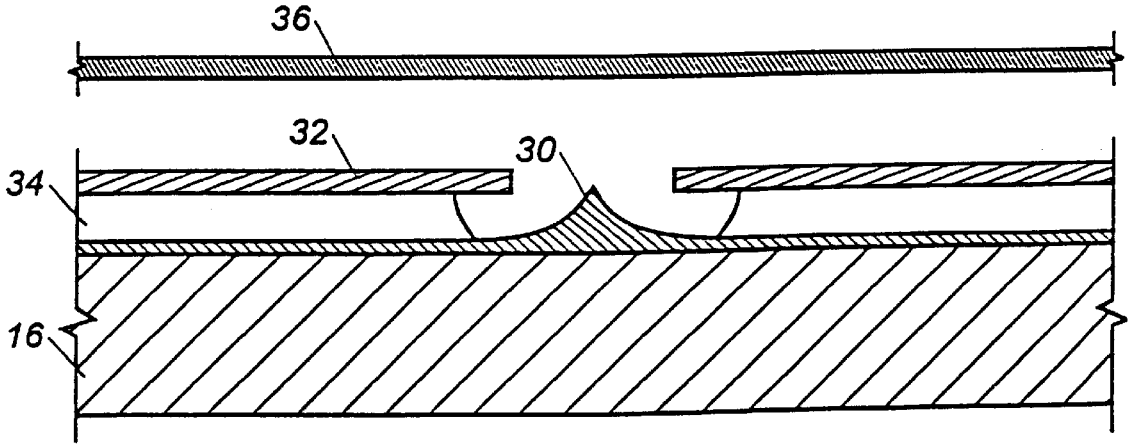
FIG. 6 shows a field emission display made in accordance with the process steps shown in FIGS. 1 through 5.

Referring now to FIG. 6, a field emission display made in accordance with the procedures described above includes a grid or extractor 32 and a dielectric layer 34, all positioned about the emitter 30. The emitter 30 is situated atop the baseplate 16. A phosphorus coated screen 36 is situated over the emitter 30 and the opening in the grid or extractor 32. Electrons emitted through the tip 24 of the emitter 30 interact with the screen 36 to produce an image which is visible from the opposite side of the screen 36. Field emission displays are described in the following U.S. Pat. Nos. 5,151,061, 5,186,670 and 5,210,472 hereby expressly incorporated by reference herein.

In this way, the present invention allows an amorphous silicon layer to be formed atop a soda-lime glass substrate without the necessity of an intervening barrier layer. With the present invention, it is possible to form a semiconductor device without using temperatures sufficient to cause diffusion of the alkaline constituents from the soda-lime glass into a silicon layer or to mechanically alter the substrate. Thus, the advantages of using the soda-lime glass can be achieved without the necessity of interposing a barrier layer between the two (which raises its own problems) while remaining at a temperature compatible with the thermal properties of the substrate. As a result, it is also possible to form large structures without the attendant cost of silicon wafers.

While the present invention has been described with respect to a limited number of embodiments, those skilled in the art will appreciate a number of modifications and variations therefrom. It is intended that the appended claims cover all such modifications and variations as fall within the true spirit and scope of the present invention.

What is claimed is:

1. A method for forming a semiconductor device utilizing a soda-lime glass structure comprising:

depositing a silicon layer directly on said soda-lime glass structure at a temperature below the temperature at which alkaline constituents in said soda-lime glass diffuse into said silicon layer;

defining a feature in said silicon layer without using temperatures in excess of the temperature at which deleterious diffusion of alkaline constituents in said soda-lime glass occurs; and oxidizing the feature on said silicon layer using a chemical oxidizer.

2. The method of claim 1 including the step of avoiding thermal alteration of the mechanical properties of the structure.

3. The method of claim 1 including the step of oxidizing the feature on said silicon layer using a chemical oxidation process at temperatures below 700° C.

4. The method of claim 3 including the step of maintaining said soda-lime glass structure at a temperature below 700° C.

5. The method of claim 1 including the step of forming a porous silicon layer on said silicon feature and selectively removing said porous silicon layer.

6. A method of claim 5 including the step of oxidizing said porous silicon using temperatures below 700° C.

7. A method of forming a field emission display comprising:

forming said field emission display with an amorphous silicon layer in contact with a soda-lime glass without causing substantial diffusion of alkaline constituents from said soda-lime glass to said silicon;

forming an emitter structure with a tip from a semiconductor layer; and sharpening the tip of said emitter structure by forming a porous silicon layer on said tip and oxidizing said porous silicon layer using a chemical oxidizer.

8. The method of claim 7 including avoiding thermal alteration of the mechanical properties of the glass substrate.

* * * * *